US008130163B2

(12) United States Patent
Minard et al.

(10) Patent No.: US 8,130,163 B2
(45) Date of Patent: Mar. 6, 2012

(54) WIDE BAND DIPOLE ANTENNA

(75) Inventors: Philippe Minard, Saint Medard sur Ille (FR); Jean-Francois Pintos, Bourgbarre (FR); Ali Louzir, Rennes (FR); Philippe Gilberton, Geveze (FR); Jean-Luc Robert, Betton (FR)

(73) Assignee: Thomson Licensing, Boulogne-Billancourt (FR)

( * ) Notice: Subject to any disclaimer, the term of this patent is extended or adjusted under 35 U.S.C. 154(b) by 434 days.

(21) Appl. No.: 11/918,685

(22) PCT Filed: Apr. 13, 2006

(86) PCT No.: PCT/EP2006/061599

§ 371 (c)(1), (2), (4) Date: Oct. 17, 2007

(87) PCT Pub. No.: WO2006/111509

PCT Pub. Date: Oct. 26, 2006

(65) Prior Publication Data

US 2009/0066599 A1 Mar. 12, 2009

(30) Foreign Application Priority Data

Apr. 20, 2005 (FR) ..... 05 51009

(51) Int. Cl.
*H01Q 9/16* (2006.01)

(52) U.S. Cl. ..... 343/793

(58) Field of Classification Search ..... 343/793, 343/805, 803, 806, 702; 455/575.7, 90.2
See application file for complete search history.

(56) References Cited

U.S. PATENT DOCUMENTS

| | | | | |
|---|---|---|---|---|
| 5,561,437 | A | 10/1996 | Phillips et al. | |
| 6,266,017 | B1 * | 7/2001 | Aldous | 343/702 |
| 6,544,075 | B1 * | 4/2003 | Liao | 439/638 |
| 6,612,874 | B1 | 9/2003 | Stout et al. | |
| 6,758,689 | B1 | 7/2004 | Bair et al. | |
| 2002/0109639 | A1 * | 8/2002 | Hung et al. | 343/820 |
| 2002/0169010 | A1 | 11/2002 | Shoji et al. | |
| 2004/0145533 | A1 | 7/2004 | Taubman | |
| 2007/0060089 | A1 * | 3/2007 | Owen et al. | 455/229 |

FOREIGN PATENT DOCUMENTS

| | | |
|---|---|---|
| JP | 2004172919 | 6/2004 |
| JP | 2004208219 | 7/2004 |
| WO | WO2004057769 | 7/2004 |

OTHER PUBLICATIONS

Wikipedia, "Antenna (radio)", published on Jun. 27, 2010, located at http://en.wikipedia.org/wiki/Antenna_(radio).*

P.M. Evjen, SRD Antennas, Chipcon Application Note AN003, Rev. 1.1, Mar. 14, 2001, pge 10.*

Search Report Dated May 30, 2006.

* cited by examiner

*Primary Examiner* — Jacob Y Choi
*Assistant Examiner* — Kyana R McCain
(74) *Attorney, Agent, or Firm* — Tutunjian & Bitetto, P.C.

(57) ABSTRACT

The present invention relates to a compact wideband antenna of the dipole type comprising a first 1 and a second 2 conductive arm supplied differentially, one of the arms called first arm 1 forming at least one cover for an electronic card. Said type of antenna is connected to a portable electronic appliance such as a PC or similar device.

10 Claims, 10 Drawing Sheets

WIDE BAND DIPOLE ANTENNA

CROSS-REFERENCE TO RELATED APPLICATIONS

This application claims the benefit, under 35 U.S.C. §365 of International Application PCT/EP2006/061599, filed Apr. 13, 2006, which was published in accordance with PCT Article 21(2) on Oct. 26, 2006 in French and which claims the benefit of French patent application No. 0551009, filed Apr. 20, 2005.

FIELD OF INVENTION

The present invention relates to a dipole type wideband antenna, more particularly an antenna for the reception of television signals particularly the reception of digital television signals on a portable electronic appliance such as a laptop computer, a PVA (Personal Assistant) or other similar device.

BACKGROUND OF INVENTION

Currently on the market, there is equipment that can receive terrestrial digital television or TNT on laptop computers or PCs. The reception of TNT signals on a laptop computer enables the computing power of the PC to be used for decoding the stream of digital images. This equipment is most frequently marketed in the form of a box with two interfaces, namely one RF (radiofrequency) interface for connection to an interior or exterior VHF-UHF antenna and a USB interface for the connection to the computer. Examples of this type are particularly given in the US patent application 2004/0263417 in the name of MICROSOFT Corporation or in the U.S. Pat. No. 6,544,075 in the name of ACCTON Technology Corporation. However, these two documents describe a device comprising a separate antenna, most frequently a whip or loop type antenna mounted on a USB unit.

Moreover, it has long been known how to use dipoles as television signal reception antennas. In general, a standard dipole comprises two identical arms with a length noticeably equal to $\lambda/4$ and placed opposite each other. The arms are supplied differentially by a generator. This type of antenna has been studied since the beginnings of electromagnetism and is used notably for UHF reception and even more recently in wireless networks of the WLAN type.

BRIEF SUMMARY OF THE INVENTION

The present invention thus uses the concept of the dipole type antenna to create a compact wideband antenna covering the entire UHF band and associated with an electronic board being able to connect to a portable device by using, particularly, a USB type connector.

Hence, the present invention relates to a dipole type wideband antenna comprising a first and a second conductive arm supplied differentially. According to the invention, one of the arms, called first arm, forms at least one cover for an electronic card.

According to a first embodiment, the first arm has the form of a box into which the electronic card is inserted.

According to a second embodiment, the first arm comprises an upper face covering the electronic card. Two side faces can be combined with this upper face.

Preferably, the first and the second arms are mounted in rotation with respect to each other and each arm has a general rectangular form with a curved profile, the profiles preferably being complementary in such a manner to be able to fold both arms against each other and thus obtain a compact, easily portable antenna.

According to one characteristic of the present invention, the electronic card comprises, at one extremity, a connection port for supplying the antenna and at the other extremity a connection port to an electronic appliance. Preferably, the connection port to the electronic appliance is a USB connection port. Moreover, the electronic card comprises circuits for processing television type signals.

BRIEF DESCRIPTION OF THE DRAWINGS

Other characteristics and advantages of the invention will appear upon reading the description of different embodiments, this description being realized with reference to the enclosed drawings, wherein.

DETAILED DESCRIPTIONOF THE INVENTION

To simplify the description, the same elements have the same references as the figures.

Figure 1:
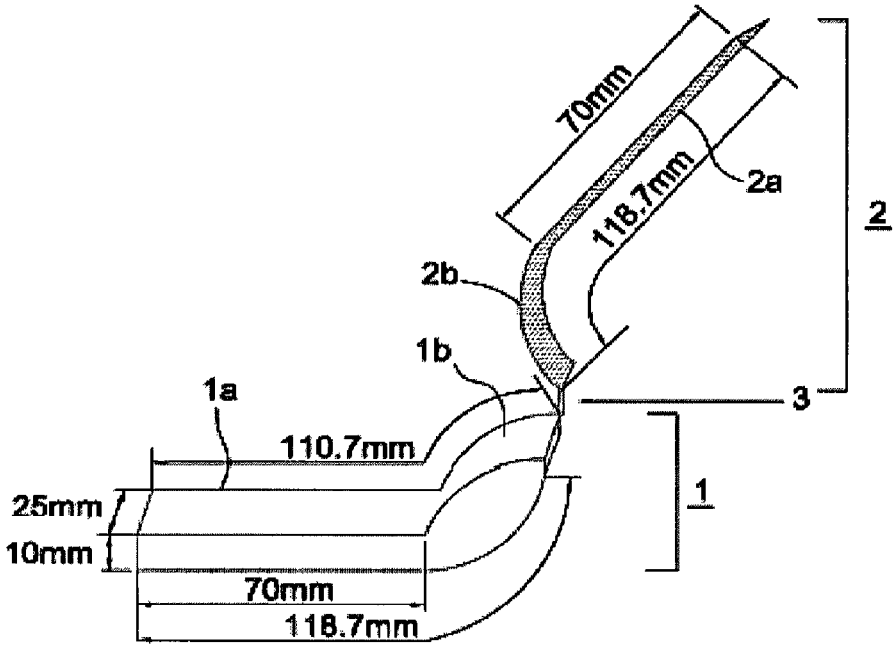
FIG. 1 is a perspective side view of a first embodiment of an antenna in accordance with the present invention.
Figure 2:
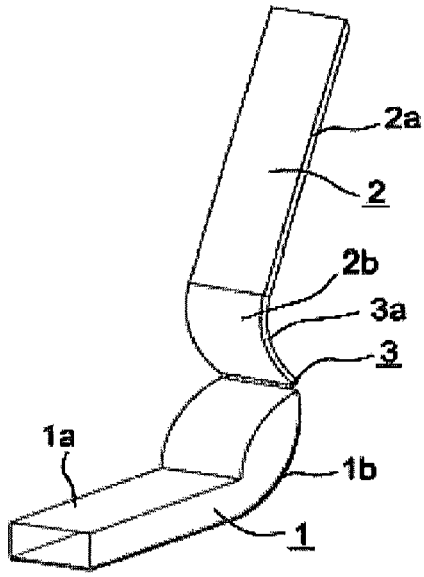
FIG. 2 is a perspective view of the antenna of FIG. 1.

With reference to FIGS. 1 and 2, a first description will be made of a first embodiment of a compact wideband antenna that can be used for receiving terrestrial digital television on a laptop computer in accordance with the present invention.

As shown diagrammatically in FIGS. 1 and 2, this dipole type antenna essentially comprises a first conductive arm 1 and a second conductive arm 2, both arms being connected to each other by means of an articulation zone 3 located at one of the extremities of each of the arms.

More specifically, the arm 2 is constituted by a rectangular plate made of a conductive metal, metallized or other material and has a length close to λ/4 at the operating central frequency, namely close to 112 mm for an operation in the UHF band (band between 460 and 870 MHz). These 2 arms have a rectilinear part 2*a* and a curved part 2*b* enabling the connection at the level of zone 3 to the other arm 1. The arm 1 has a form such that it can be used at least as a cover for an electronic card that will be described in more detail hereafter.

More specifically, the arm 1 shown in FIGS. 1 and 2 comprised a rectangular part 1*a* forming a unit into which the said card can be inserted and it extends by a curved part 1*b* forming a gradual tapering that enables the energy to be radiated gradually and, in this manner, increases an impedance matching for a larger frequency band. The length of the arm 1 is also noticeably equal to λ/4. Arm 1 is made from a metal, metallized or other material.

As shown in FIG. 1, the arms 1 and 2 have almost identical total lengths, namely a length of 118.7 mm in the embodiment shown. More specifically, the rectilinear part has a length of 70 mm and a width of 25 mm. Moreover, the arm 1 in the form of a box has a height of 10 mm. The two arms 1 and 2 are linked to each other at the level of an articulation zone 3 that comprises in 3*a* a connection element enabling the antenna to be connected to a generator or receiver circuit for processing electromagnetic signals. In order not to disturb the electromagnetic operation of the antenna, the articulation zone comprises connection elements made using material that is relatively transparent to radio waves whereas the electrical connection is provided by a metal strand, a coaxial or similar cable connected to the generator or receiver circuit for processing electromagnetic signals. In order to prevent a short-circuit between the metal strand and the arm 2, an opening is necessary in the arm 2.

As mentioned above, the two arms 1 and 2 are made of a conductive material, particularly metallic. Hence, they can be made from metal plates by cutting the said plates.

The antenna of FIG. 2 showing the sizes given above was simulated using a commercial electromagnetic software (IE3D). In these simulations, the antenna is assumed to be in the air and constituted by a conductive material with good conductivity ($\sigma >= 5 \cdot 10^7$ S/m). The results of the simulations are given in the curves of FIGS. 3 to 6 which chiefly relate to a simulation made on the antenna alone and a simulation made when the antenna is connected to an impedance matching circuit such as described with reference to FIG. 11.

Figure 3:
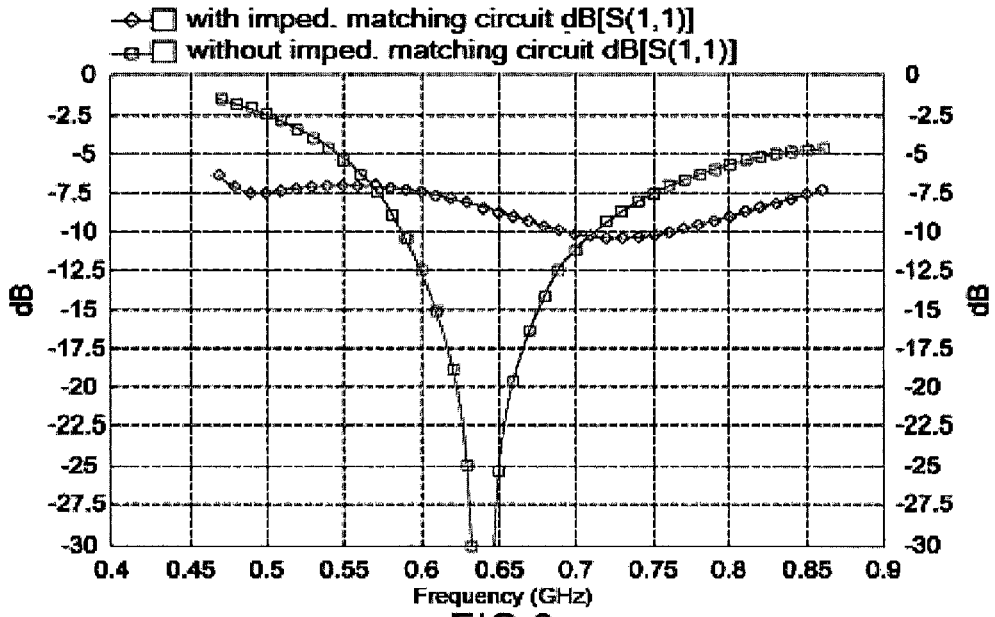
FIG. 3 shows impedance matching curves S11 as a function of the frequency for the antenna of FIG. 2, respectively with and without an impedance matching circuit.
Figure 4:
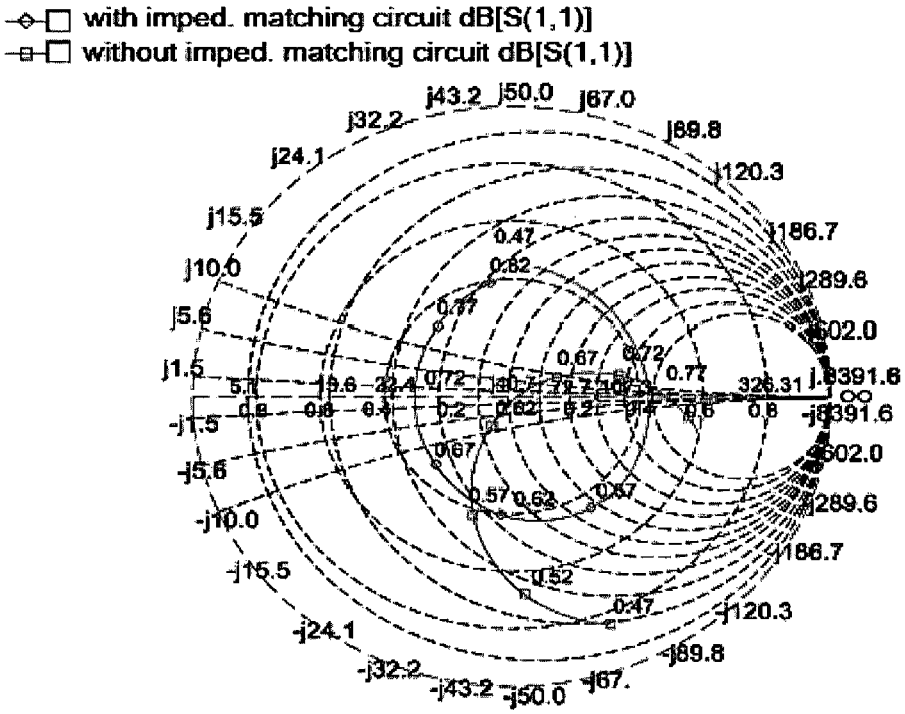
FIG. 4 shows a Smith abacus of the antenna of FIG. 2 with and without an impedance matching circuit.

FIG. 3 shows the impedance matching curves of the antenna of FIG. 2 with and without an impedance matching circuit. These curves show that the impedance matching cell can obtain good impedance matching over the entire UHF band, namely the frequency band between 460-870 MHz whereas the curve obtained without an impedance matching circuit can obtain good impedance matching over a more restricted frequency band. This is confirmed on the Smith abacus of FIG. 4.

Figure 5:
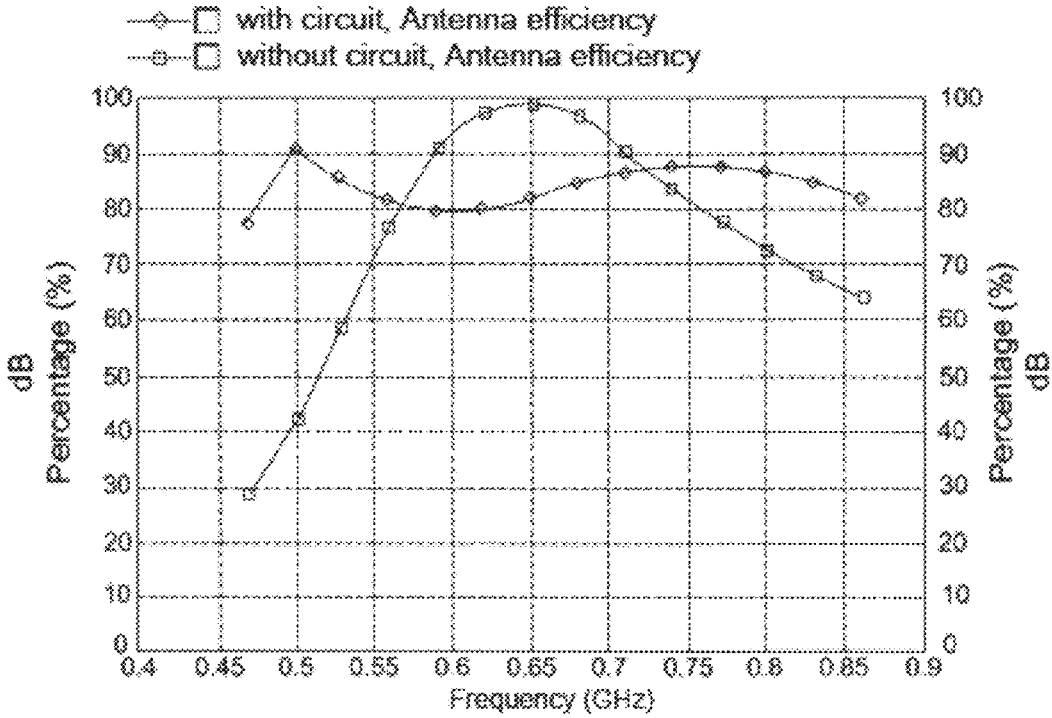
FIG. 5 shows the curves indicating the efficiency of the antenna according to frequency with or without an impedance matching circuit.

FIG. 5 shows the curves indicating the efficiency of the antenna with and without an impedance matching circuit. The curves obtained confirm the previous results and show that an antenna efficiency greater than 80% is obtained for the entire UHF band when an impedance matching circuit is used.

Figure 6:
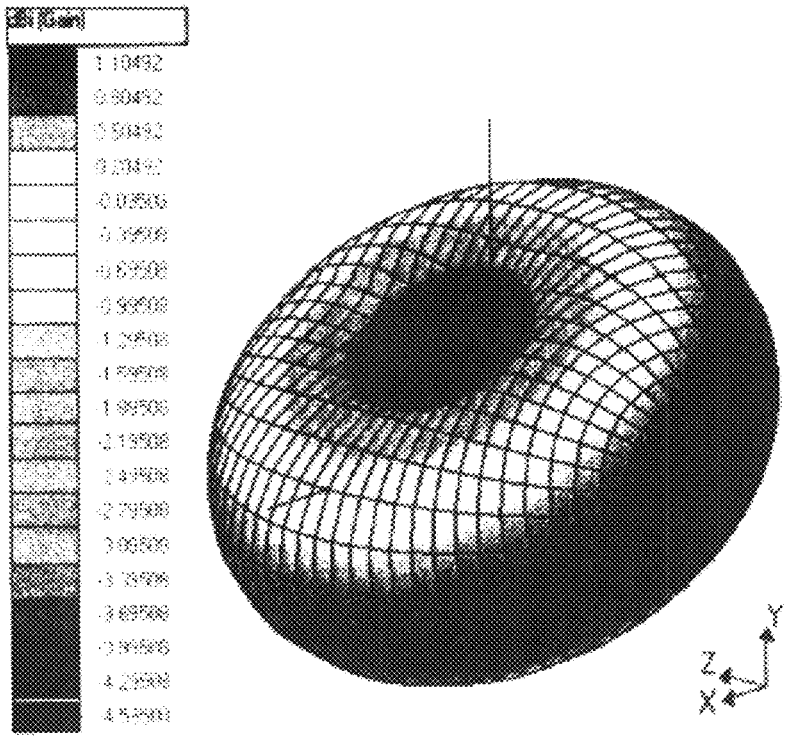
FIG. 6 is a gain radiation pattern of the antenna of FIG. 2.

The radiation diagram of FIG. 6 is a gain radiation diagram that confirms that the antenna of FIG. 2 operates as a dipole.

Figure 7:
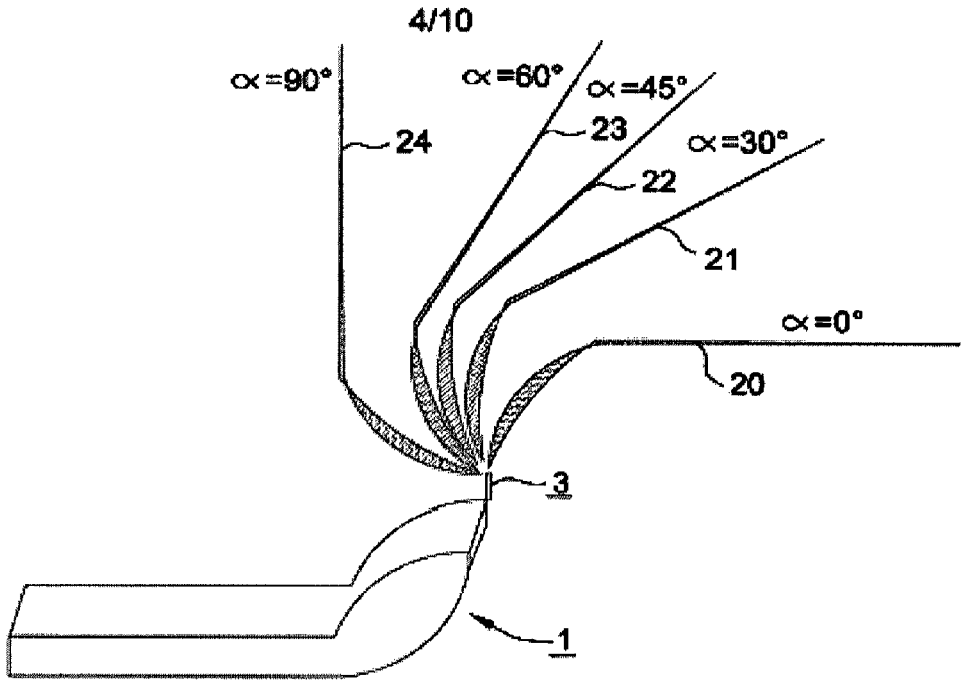
FIG. 7 is an identical representation of FIG. 1 in which the second arm takes up different positions.

As mentioned above, the arm 2 of the antenna is mounted in rotation with respect to the arm 1, in such a manner as to direct the antenna for optimum reception. In FIG. 7, different positions of the arm 2 with respect to arm 1 are shown, namely one position in which the angle ∝ between the two arms is equal to 0° referenced 20, one position in which the angle ∝ between the two arms is noticeably equal to 30° referenced 21, one position in which the angle ∝ made by the two arms is noticeably equal to 45° referenced 22, one position in which the angle ∝ between the two arms is noticeably equal to 60° referenced 23 and one position in which the angle ∝ between the two arms is noticeably equal to 90° referenced 24.

To determine the influence of the inclination of the arm 2 with respect to arm 1, simulations were carried out for the different positions of the arm. The results of the simulations are provided respectively in FIGS. 8, 9 and 10.

Figure 8:
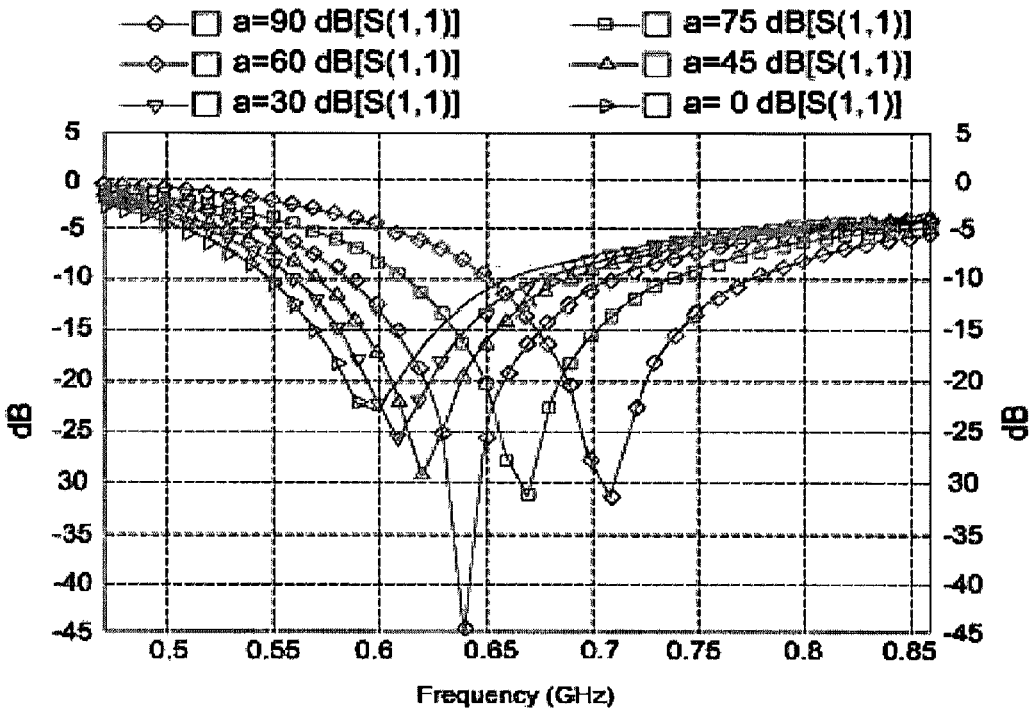
FIG. 8 shows the curves indicating the impedance matching according to frequency for the different positions of the arm 2 shown in FIG. 7.

FIG. 8 shows the different curves indicating the impedance matching according to the frequency for the different positions of the arm 2. It will be noted that the antenna is naturally impedance matched for high frequencies when the value ∝ of the angle is low and vice versa. In fact, the electric field E can easily be established at the low frequencies when the angle ∝=0° respectively at the high frequencies when the angle ∝=90°.

Figure 9:
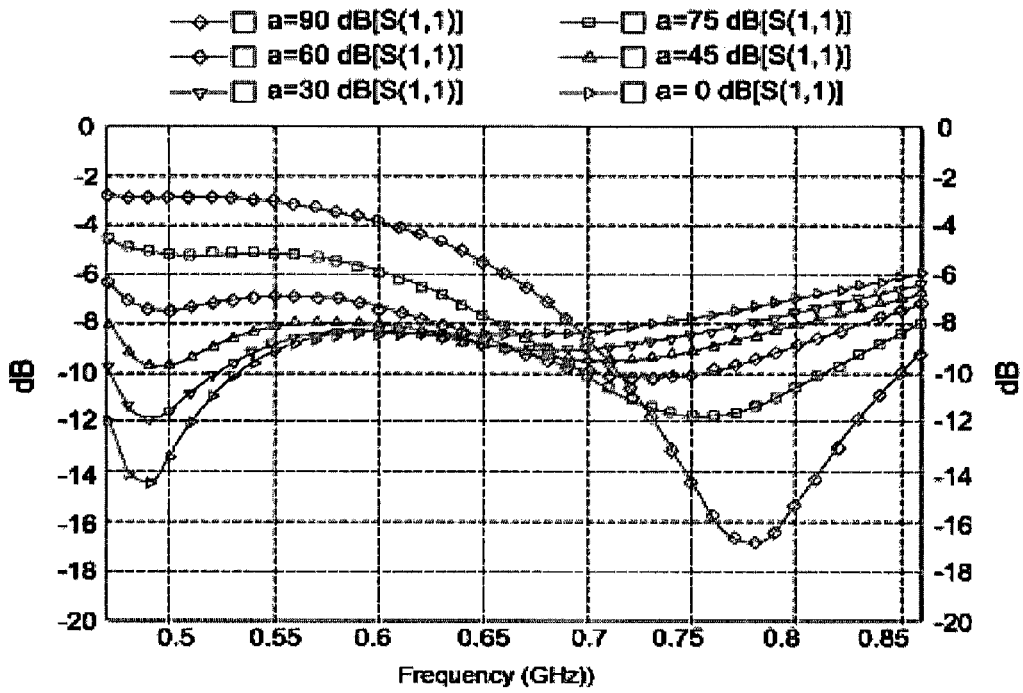
FIG. 9 shows the curves indicating the impedance matching according to frequency for the different positions of the arm 2 shown in FIG. 7 when the antenna is followed by an impedance matching circuit.
Figure 11:
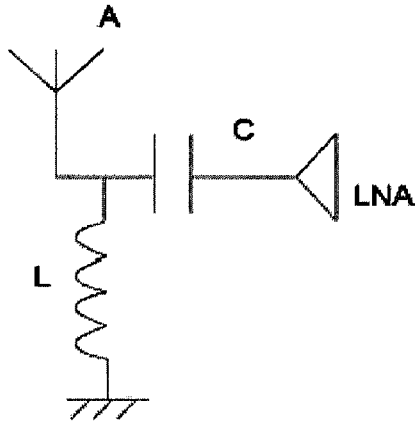
FIG. 11 diagrammatically shows an impedance matching circuit provided at the antenna output.

FIG. 8 provides the results for the antenna alone. In this case, the antenna is not impedance matched over the entire UHF frequency. If an impedance matching cell such as the one shown in FIG. 11 is used, the impedance matching curves of FIG. 9 are obtained in this case. According to these curves, the upper band has good impedance matching with a coefficient S11 less than −6 dB for all the positions of the arm 2 and the low band has good impedance matching with S11 less than −6 dB for the positions of the arm 2 between 0° et 60°.

Figure 10:
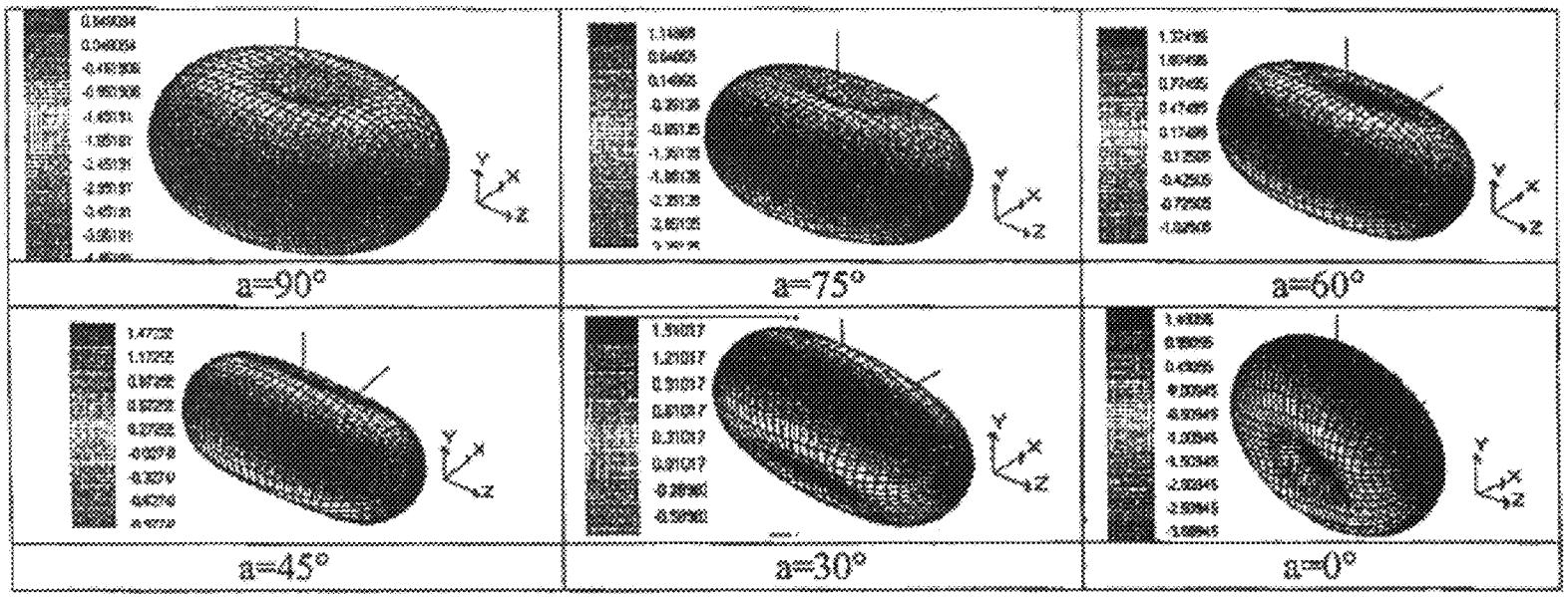
FIG. 10 shows the gain radiation patterns of the antenna of FIG. 7, for the different positions of the arm 2.

Moreover, FIG. 10 shows the radiation patterns at a frequency of 660 MHz for the various position of the arm 2 of the antenna. The radiation patterns are tilted according to the angle of inclination ∝. This inclination can optimise the reception of the digital television signal.

An impedance matching cell being able to be used in the present invention is shown diagrammatically in FIG. 11. In this figure, the antenna A is connected to the cell constituted by an inductor L and a capacitor C. The antenna is connected in series with the capacitor C which is connected to a low noise amplifier LNA, whereas the inductor L is mounted between the ground and the connection point of the antenna to the capacitor C.

To obtain good impedance matching, the value of the capacitor C and the inductor L are such that C=5 pF and L=15 nH. This impedance matching cell was optimised for an arm tilted at an angle ∝ equal to 60°.

Figure 12:
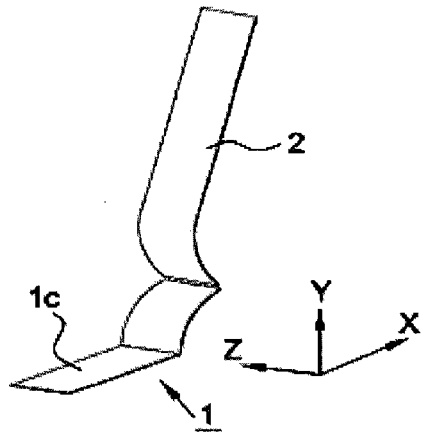
FIG. 12 is a diagrammatic perspective view of a second embodiment of an antenna in accordance with the present invention.
Figure 13:
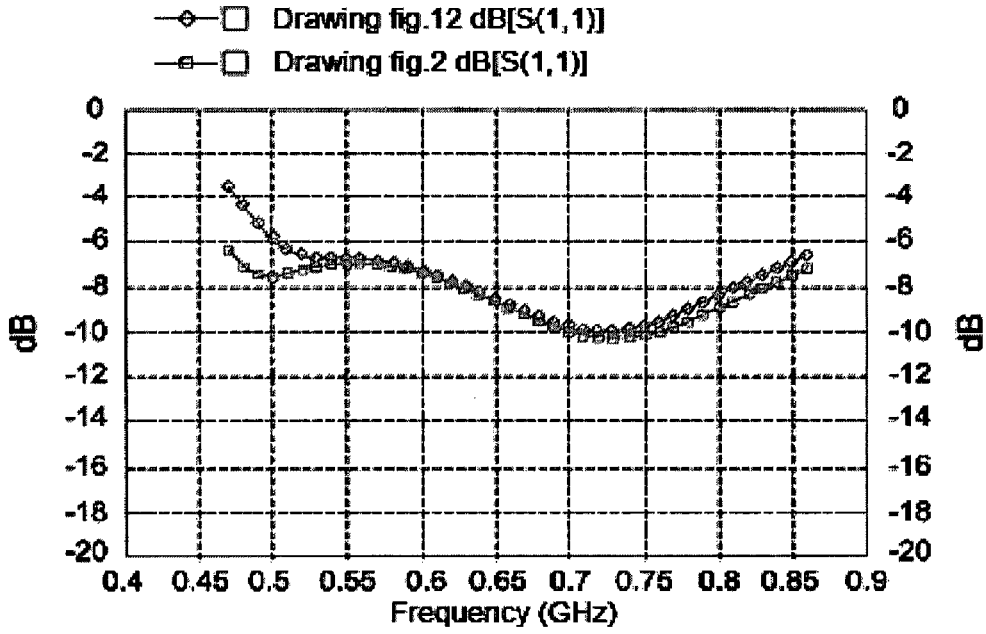
FIG. 13 and FIG. 14 respectively show curves indicating the impedance matching according to frequency and curves indicating the efficiency of the antenna according to frequency, respectively for the antenna of FIG. 12 in comparison with the antenna of FIG. 2.
Figure 14:
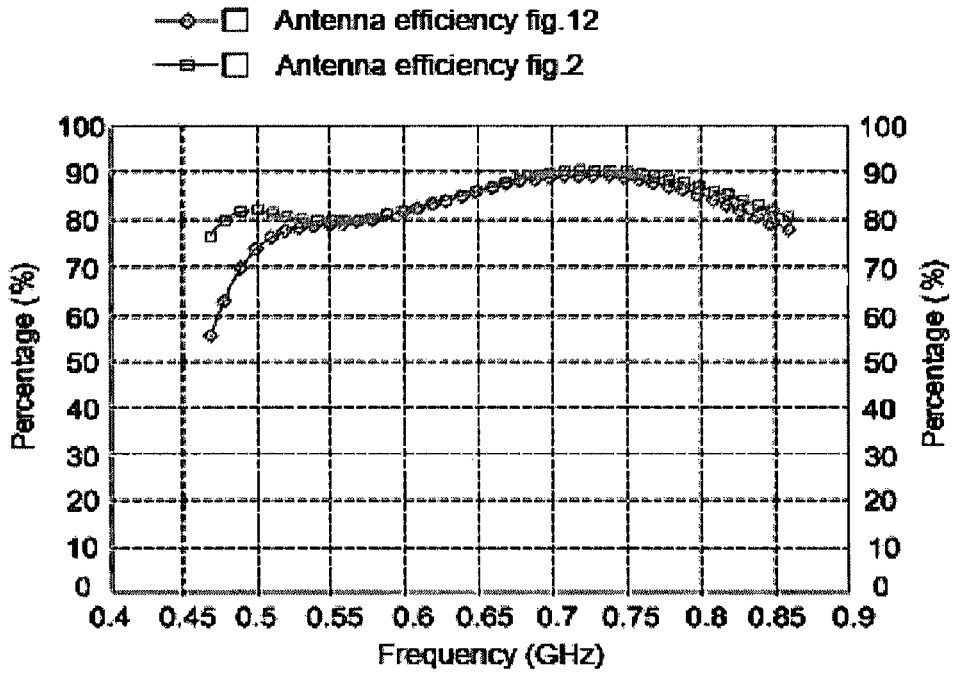

With reference to FIGS. 12, 13 and 14, a first embodiment variant of the present invention will now be described. As shown in FIG. 12, in this case the antenna comprises an arm 2 identical to the arm 2 of FIG. 2 and an arm 1 constituted only by the upper face 12 of the box forming the arm 1 of FIG. 2. In this case, the impedance matching and efficiency curves shown respectively in FIGS. 13 and 14 are obtained. The curves of FIG. 13 which compare the impedance matching of the antenna of FIG. 12 with the antenna of FIG. 2 show that good impedance matching is still obtained over the entire UHF band. The curves of FIG. 14 show that, in this case, the efficiency of the antenna of FIG. 12 is lower than that of the antenna of FIG. 2 in the low band owing to the elimination of the side and lower walls of the arm 1 of FIG. 2.

Figure 15:
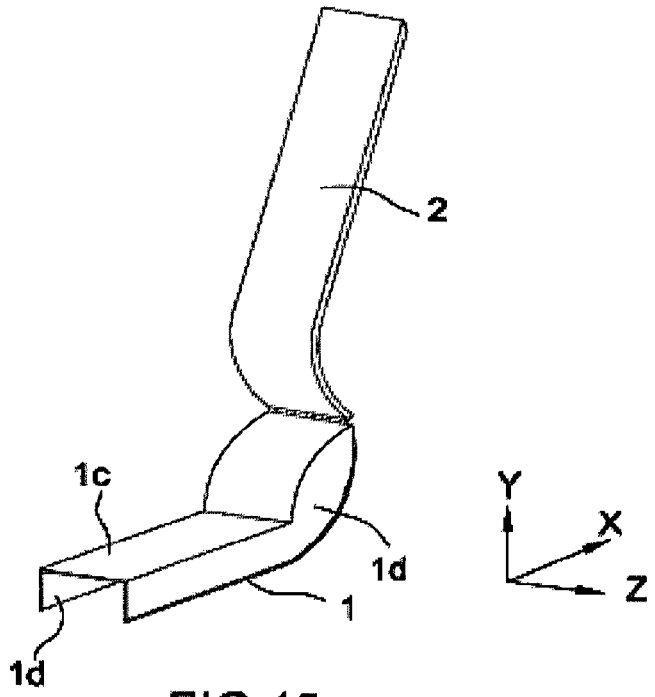
FIG. 15 is a diagrammatic perspective view of a third embodiment of the present invention.
Figure 16:
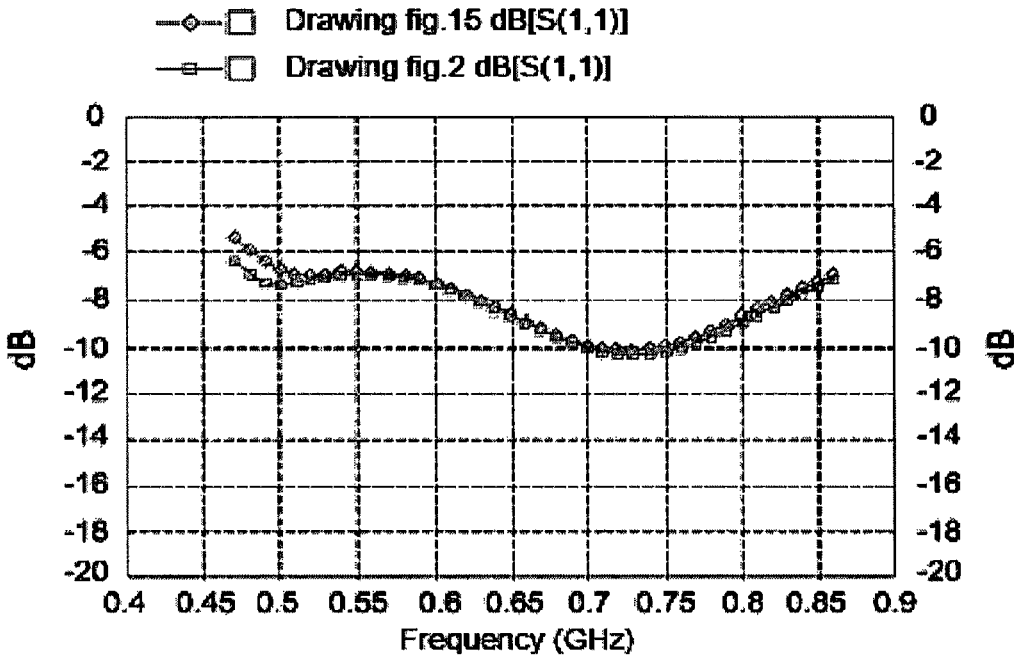
FIG. 16 and FIG. 17 respectively show curves indicating the impedance matching according to frequency and efficiency of the antenna according to frequency for the antenna of FIG. 15 in comparison with the antenna of FIG. 2.
Figure 17:
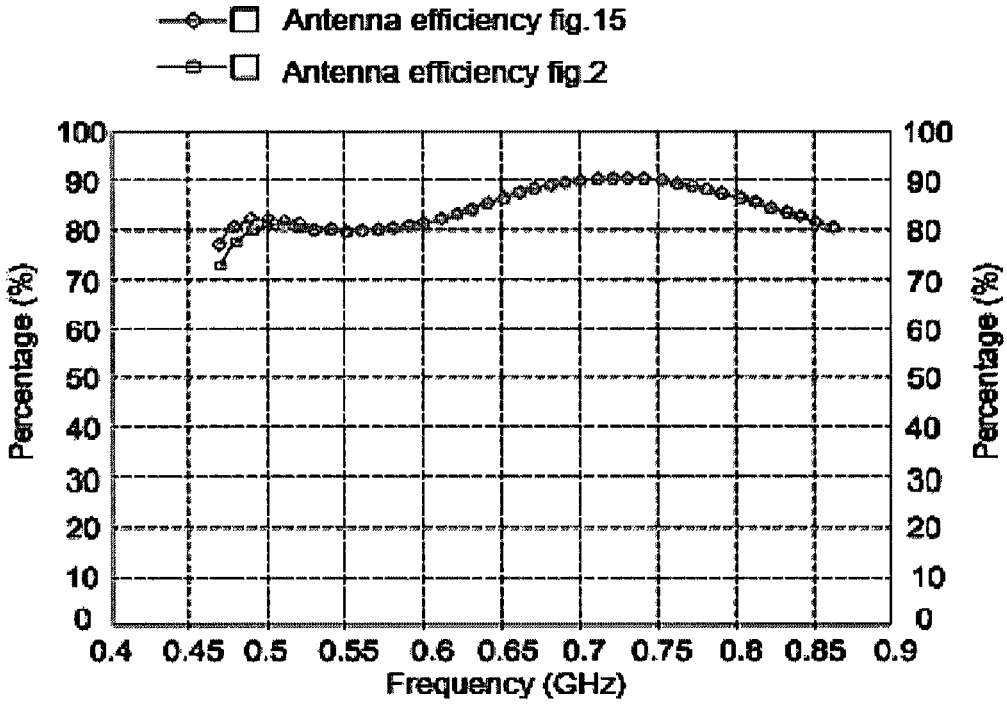

With reference to FIGS. 15, 16 and 17, a third embodiment of the present invention will now be described. In this case, the arm 2 is identical to the arm 2 of the antennas of FIGS. 2 and 12 whereas the arm 1 only comprises the upper face 1*c* and the side faces 1*d*. In this case, the arm 1 forms a cover fitting onto the electronic card. The results of the simulation shown in FIGS. 16 and 17 demonstrate that this embodiment gives noticeably similar results to the embodiment of FIG. 2. Said embodiment has the advantage of being able to be industrialised more easily than the embodiment of FIG. 2.

Figure 18:
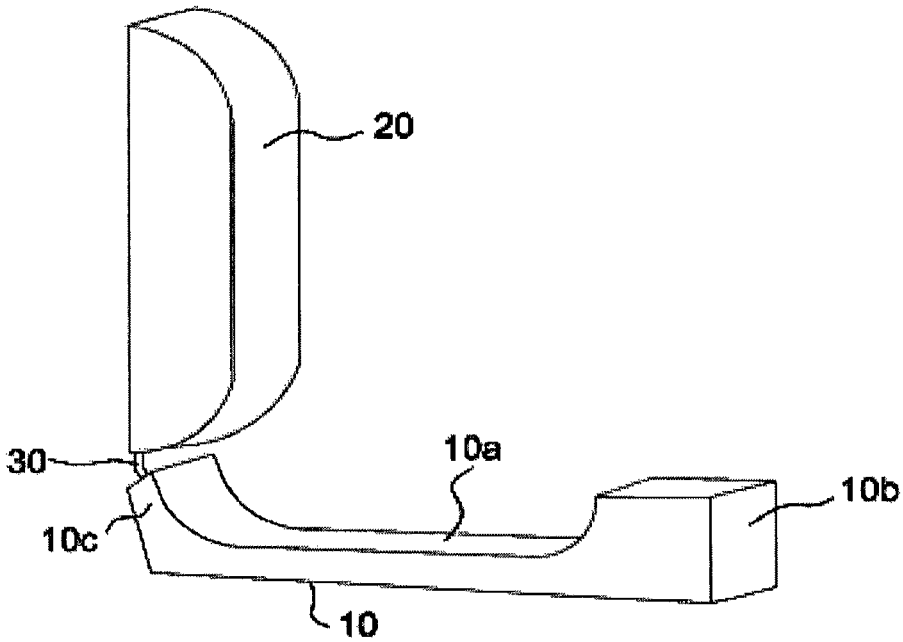
FIG. 18 shows a diagrammatic perspective view of a fourth embodiment of the present invention.

A description will now be given, with reference to FIG. 18, of another embodiment of an antenna in accordance with the present invention. In this case, the arm 10 is constituted by an element having the form of a rectangular box the upper surface of which is stamped in such a manner as to obtain a part 10*c*. Said stamped part can receive the arm 20 when it is folded for transport. The arm 20 has a form corresponding to a half-ellipse. The dimensions of the arms 10 and 20 are noticeably identical and correspond to approximately $\lambda/4$ at the required operating frequency. As in the case of the other figures, the arm 10 and the arm 20 are interconnected at the level of an interconnection zone 30 in such a manner as to be able to turn in relation to each other.

Figure 19:
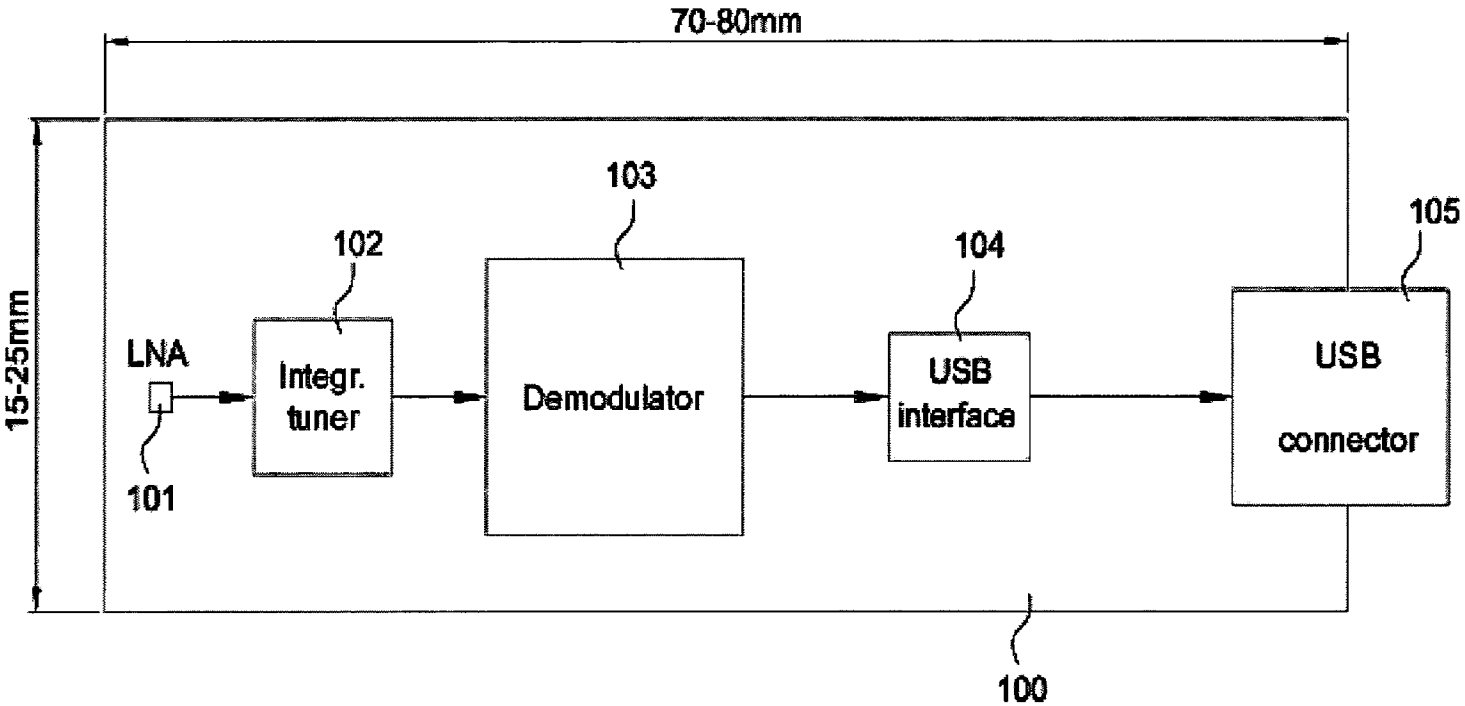
FIG. 19 is diagrammatic view of an electronic card used in the present invention.

With reference to FIG. 19, a description will now be made of an embodiment of an electronic card in accordance with the present invention, the arm 1 of the antenna forming a cover or a box for this electronic card. This electronic card can comprise all the integrated circuits necessary for processing a digital television signal. As shown in FIG. 14, this card 100 thus comprises a low noise amplifier 101 connected at the output of the antenna at the level of the rotation zone 3 or 30 of the antenna, the signal from the LNA amplifier is sent to a tuner 102 then to a demodulator 103 connected to a USB interface 104. The electronic card featuring a USB connection port 105. If necessary, the electronic card can feature a shielding of the RE part.

It is obvious to those in the skilled art that other types of connection port enabling connection to an electronic appliance can be used, such as for example the formats used for memory cards (Compact Flash, SD, XD, etc.)

The said electronic card can be produced such that it has a length between 70-80 mm and a width between 15-25 mm in such a manner as to be able to insert it easily into the arm 1 forming the box as shown in FIG. 2.

It is obvious that the electronic card described above only constitutes one example of electronic card being able to be used in the case of the present invention. According to the embodiment variants, this card can also be integrated into a standard USB key used for carrying personal data, photos or music.

The invention claimed is:

1. Compact UHF wideband antenna of the dipole type comprising a first conductive arm and a second conductive arm, the first and the second conductive arms being linked to each other at the level of an articulation zone located at one of the extremities of each of the arms, said first and second conductive arms being fed by one feed line at the level of said articulation zone, one of the arms called first arm forming at least a cover for an electronic card, wherein each arm has a general rectangular form extending by a curved profile at the level of the articulation zone to widen the frequency band.

2. Antenna according to claim 1, wherein the first arm has the form of a box into which the electronic card is inserted.

3. Antenna according to claim 1, wherein the first arm comprises an upper face covering the electronic card and two side faces.

4. Antenna according to claim 3, wherein the first arm additionally comprises two side faces.

5. Antenna according to claim 1, wherein the first and the second arms each have a length equal to $\lambda/4$ at the operating central frequency of the antenna.

6. Antenna according to claim 1, wherein the first and the second arms are mounted in rotation with respect to each other.

7. Antenna according to claim 1, wherein the first and the second arms have complementary profiles enabling them to be folded into each other.

8. Antenna according to claim 1, wherein the electronic card comprises, at one extremity, a connection port for supplying the antenna and at the other extremity a connection port to an electronic appliance.

9. Antenna according to claim 8, wherein the connection port to the electronic appliance is a USB connection port.

10. Antenna according to claim 8, wherein the electronic card comprises circuits for processing television type signals.

* * * * *